US012433350B2

(12) United States Patent
Murphy

(10) Patent No.: US 12,433,350 B2
(45) Date of Patent: Oct. 7, 2025

(54) GARMENT WITH SELECTIVE ENLARGEMENT AND COMPRESSION

(71) Applicant: Bittyrina LLC, Valley Village, CA (US)

(72) Inventor: Brett Lindsay Murphy, Valley Village, CA (US)

(73) Assignee: Bittyrina LLC, Valley Village, CA (US)

( * ) Notice: Subject to any disclaimer, the term of this patent is extended or adjusted under 35 U.S.C. 154(b) by 0 days.

(21) Appl. No.: 18/585,458

(22) Filed: Feb. 23, 2024

(65) Prior Publication Data

US 2024/0188654 A1 Jun. 13, 2024

Related U.S. Application Data

(63) Continuation-in-part of application No. 17/096,818, filed on Nov. 12, 2020, now abandoned.

(60) Provisional application No. 62/934,199, filed on Nov. 12, 2019.

(51) Int. Cl.

| | |
|---|---|
| ***A41D 1/22*** | (2018.01) |
| ***A41D 27/02*** | (2006.01) |
| ***A41D 31/30*** | (2019.01) |

(52) U.S. Cl.

CPC ..... *A41D 1/22* (2013.01); *A41D 27/02* (2013.01); *A41D 31/30* (2019.02); *A41D 2300/322* (2013.01); *A41D 2400/38* (2013.01)

(58) Field of Classification Search

CPC ..... A41D 13/0017; A41D 31/30; A41D 2300/322; A41C 3/08; A61F 13/08

See application file for complete search history.

(56) References Cited

U.S. PATENT DOCUMENTS

| | | | | |
|---|---|---|---|---|
| 2006/0277647 | A1 | 12/2006 | Dobkin | |
| 2010/0024101 | A1* | 2/2010 | Berner, Jr. | A41D 13/05 2/243.1 |
| 2012/0078147 | A1 | 3/2012 | Ogulnick et al. | |
| 2017/0304670 | A1* | 10/2017 | Herron | A63B 21/065 |
| 2018/0116306 | A1 | 5/2018 | Andre | |
| 2020/0120999 | A1* | 4/2020 | Mason | A41D 31/18 |
| 2021/0145084 | A1* | 5/2021 | Szilagyi | A41D 13/0017 |

* cited by examiner

*Primary Examiner* — Khoa D Huynh
*Assistant Examiner* — Erick I Lopez
(74) *Attorney, Agent, or Firm* — Perkins Coie LLP

(57) ABSTRACT

A garment with selective compression may include multiple regions associated with different parts of a user's body, such as the arms, chest, midsection, buttocks, and legs. Each region of the garment may have a different level of compression. Higher levels of compression may provide support and alter the shape of the associated body part, while lower levels of compression may provide a smooth appearance without altering shape. By having selective compression levels for each region, the garment can smooth or shape different parts of the user's body in order to achieve a user's desired appearance, in addition to selectively providing different levels of support and increasing overall comfort and functionality.

20 Claims, 11 Drawing Sheets

GARMENT WITH SELECTIVE ENLARGEMENT AND COMPRESSION

CROSS-REFERENCE TO RELATED APPLICATIONS

This application is a continuation in part of U.S. Utility application Ser. No. 17/096,818 titled "GARMENT WITH SELECTIVE SUPPORT AND COMPRESSION," and filed Nov. 12, 2020, which claims the benefit of and priority to U.S. Provisional Application No. 62/934,199, titled "GARMENT WITH SELECTIVE SUPPORT AND COMPRESSION," and filed Nov. 12, 2019, upon which is incorporated by reference hereto.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present disclosure relates generally to garments, and more specifically, to a garment that selectively provides regions providing varying levels of compression and support.

BACKGROUND

Users may wear specific garments designed to provide support to various regions of the body. For example, a compression shirt may provide compression to the torso and arms of a user. As another example, a compressive undergarment may compress the waist and midsection of the user.

Compressive garments may be worn by the user to generally smooth and reduce the appearance of various portions of the body. For example, a compressive undergarment may reduce the appearance of cellulite on the user.

In many cases, users may generally desire to wear a garment that provides compression and support to various regions of the body while providing minimal compression in other areas. For example, a user may want greater compression and support to their midsection and less compression in the buttocks area of the user. However, many compressive garments may only provide uniform compression across the entire garment, preventing selective compression to various regions of the body.

BRIEF DESCRIPTION OF THE DRAWINGS

The present embodiments are illustrated by way of example and are not intended to be limited by the figures of the accompanying drawings.

Like reference numerals refer to corresponding parts throughout the figures and specification.

DETAILED DESCRIPTION

Figure 1A:
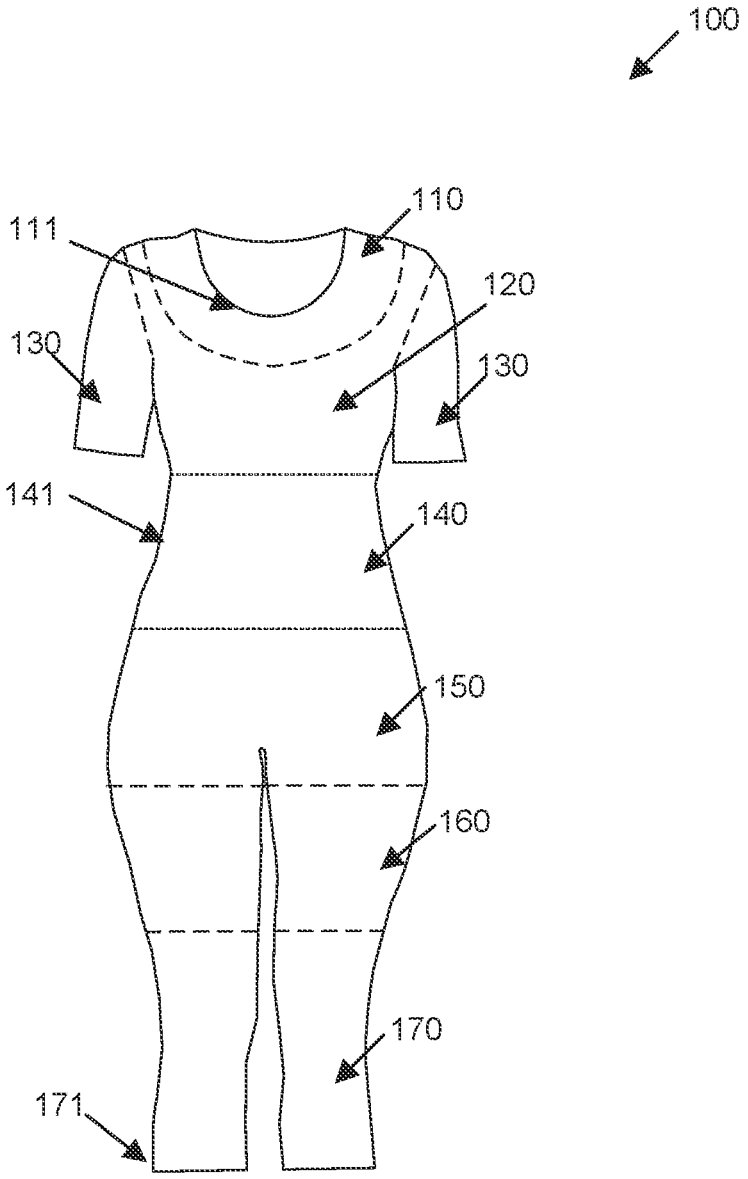
FIG. 1A illustrates a front view of a garment with selective compressive regions.

Users may wear specific garments designed to provide support to various regions of the body. Compressive garments may be worn by the user to generally smooth and reduce the appearance of various portions of the body. For example, a compressive undergarment may reduce the appearance of cellulite on the user.

In many cases, users may generally desire to wear a garment that provides compression and support to various regions of the body while providing minimal compression in other areas. This may smooth out specific regions of the body while accentuating other regions of the body, increasing aesthetics and a desired appearance of the user. As an example, a user may want greater compression and support to their midsection and less compression in the buttocks area of the user.

However, many compressive garments may only provide uniform compression across the entire garment, preventing selective compression to various regions of the body. For example, a compressive bodysuit may provide uniform compression across the body of the user. Such a garment may be uncomfortable to the user and lower overall desired aesthetics of the user, as specific regions are unable to be accentuated by the user.

The present embodiments relate to a garment configured to provide varying levels of compression and support selectively across a body of a user. The garment may selectively provide greater compression to some regions, such as a midsection region of the user, while providing less compression in other regions, such as a buttocks region.

Selectively providing varying levels of compression and support across the garment may provide a desired aesthetic for a user, as the garment can compress and smooth out specific parts of the body while accentuating other parts of the body. The garment can provide greater comfort while wearing the garment and may minimize the appearance of moving and shaking, smooth dips and dimples, and accentuate natural curves of the body of the user.

The garment may include built-in bra support, shapewear, and selective compression to assist in supporting various body parts. The fabric may include an anti-microbial material to mitigate proliferation of microorganisms and allow the user to wear the garment during many occasions. For example, the user may work from home, engage in a workout, then eat dinner, all while wearing the garment. The garment may be worn as either an undergarment or as an outfit. The compression may provide comfortable firming in select areas. For example, the selective compression may eliminate the appearance of cellulite in thighs, while only smoothing the buttocks of the user.

Further, the garment may include any of a waist-cinching zipper, gentle and effective arm compression, and built-in shapewear. The garment may include a light-weight lining of the bodice, waist, buttocks, and sleeves that can allow for the insertion of bra cups and additional compression mechanisms (padding, lipo foam, binding, etc.). Unlike other garments (e.g., shapewear and post-surgical garments), the garment as described herein is not solely designed to be hidden under clothing. It is a single garment that is multi-dimensional and operates in many capacities. For example, the garment may be used for fashion, as activewear, for maternity or post-partum wear, or for post-surgery use.

The garment may also include any of varying pant and sleeve lengths. A fastener, such as a zipper, may be placed down the front, down the back, or on the side along the waist. Heavy compression may be included in the arm sleeves, the thigh area, or the stomach and waist area. A lighter compression may be included in the buttocks area.

FIG. 1A illustrates a front view of a garment 100 with selective compressive regions. In the embodiment as shown in FIG. 1A, the garment can include a body suit with multiple regions configured to fit between the neck and ankles of the user, i.e. wearer. In some embodiments, the garment as described herein can be configured to fit around any region of the body, including as a shirt, waistband, or pair of pants.

As shown in FIG. 1A, the garment 100 can include multiple regions, i.e. portions. Example regions for the garment can include a neck region 110 near the neck of the user, a chest region 120 around the chest of the user, an arm region 130 around the arms of the user, a midsection region 140 around a waist of the user, a buttocks region 150 around the buttocks of the user, a thigh region 160 around the thighs of the user, or a leg region 170 around the legs of the user. The various regions 110, 120, 130, 140, 150, 160 of the garment 100, can be connected together, such as by stitching, to form a unitary garment.

The neck region can include a plunging neckline 111 that provides support such that the chest of the user is lifted and enhanced. The neck region can also include a wide neckline that makes it easier for the user to pull the garment up or down, for example when putting on or removing the garment. The arm region 130 can include compression sleeves that compress the arms and can make arms appear firm, toned and trim. The arm region 130 compression can be higher than the chest region 120 compression. The compression sleeves can also assist in holding the garment more securely on the user, thus enabling a wider neckline that makes it easier to pull the bodysuit up and down, and put the bodysuit, which can be tight, on the body.

Shapewear 141 built into midsection region 140 of the garment 100 may compress bulges or cellulite to provide a desired aesthetic.

For example, the user may desire to have an appearance including a slimmer waist and toned arms but keep a more voluminous appearance in the legs and buttocks. In such an example, the user can wear a garment including higher compression in the midsection and arms regions, but lesser compression in the legs and buttocks regions.

The garment may include any suitable fabric. The garment may include an antimicrobial activewear fabric, such as polyester, polyester-vinyl composites, vinyl, acrylics, synthetic fibers (e.g., elastane), or a combination of any such fabrics. The fabric(s) of the garment may be flexible such that the garment provides compression as described herein. In some embodiments, the garment may include a waterproof fabric such that the garment can be worn while the user swims. Example waterproof fabrics include PUL fabric, TPU fabric, and polyester or nylon treated with water repellent coatings.

The leg region 170 of the garment may lightly compress legs and minimize, for example, appearance of any cellulite. The leg region may include varying lengths. For example, the leg region can extend between any of the thigh region 160 of the user and an ankle region of the user. In other words, the leg region may comprise a shorts length, a full pant length, a mid-ankle length, a calf length, or any other suitable length. FIG. 1A shows an embodiment with a calf length leg region 171.

As noted above, the regions of the garment can have varying levels or degrees of compression. A level of compression may be represented by a measurement of pressure, such as a millimeter of mercury (mmHg). A higher level of compression will be represented by a higher pressure in mmHg and alter the appearance of the body of the user from a natural state to a greater degree than a lower level of compression. For example, a minimal level of compression may have pressure <8 mmHg and provide a smoothing effect on the body of the user without affecting the size or shape of the body. A mild compression may range between 8 to 15 mmHg and provide a greater smoothing effect on the body of the user and adjust the shape and size of the body while providing light support. A moderate compression may range between 15 to 20 mmHg and adjust the apparent shape of the user's body to a greater degree than a mild compression along with providing greater support. A firm compression may range between 20 to 30 mmHg, and may be used to change the appearance of the user's body to a greater degree than mild or moderate compressions. A firm compression may also provide more support than mild or moderate compressions. As an example, a user may desire to shrink the user's waist dramatically, tone and firm the user's thighs, and smooth other areas of the user's body without reducing the apparent size or altering the shape of those areas. Accordingly, a midsection region 140 can include a firm level of compression, a thigh region 160 can include a moderate level of compression less than that of the midsection region, and the arm region 130 or leg region 170 can include a mild level of compression less than that of the thigh region. In this example, other regions, such as the buttocks region and the chest, can have a minimal level of compression.

The level of compression needed to achieve a desired aesthetic may vary with the user of the garment. For example, a user with a 34 inch waist size may use a higher level of compression in the midsection region than a user with a 32 inch waist size to achieve a desired waist size. In another example, a user with more elastic skin may use a lower level of compression than a user with less elastic skin to achieve a desired smooth appearance.

In some embodiments, the garment may include one or more pockets. The pockets can include suitable sizes to receive various items such as a credit card, mobile phone, or key ring. The pockets may be disposed on any region of the garment. For example, the pockets may be disposed on the outer thigh such that the user can easily access the pockets. A pocket may also be disposed on a sleeve to hold a phone while the user exercises.

Figure 1B:
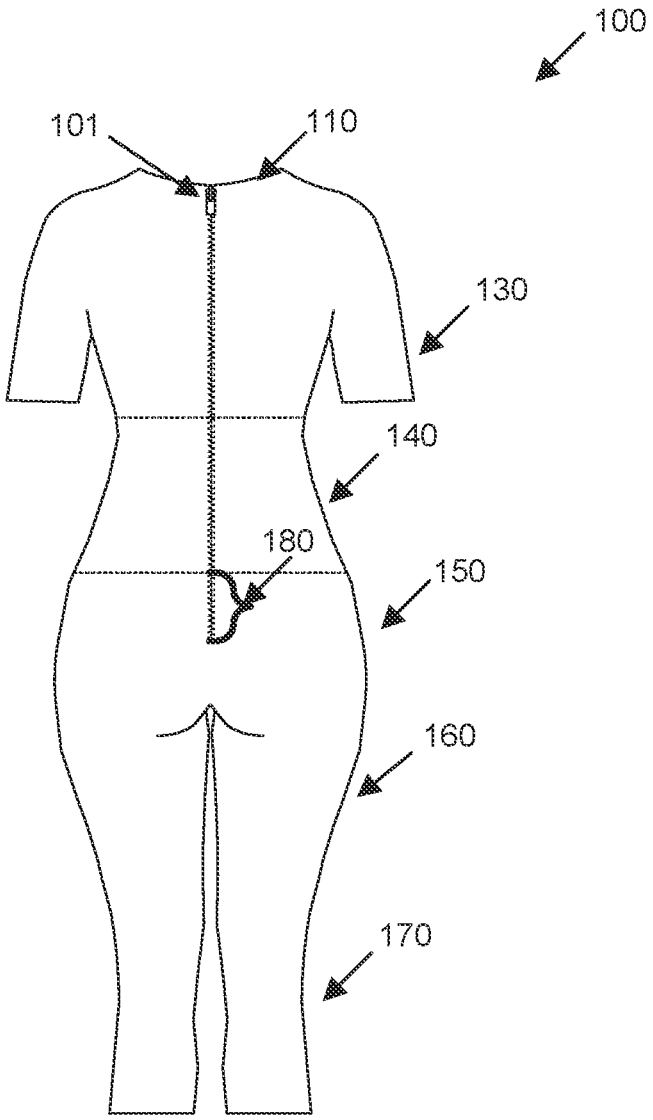
FIG. 1B illustrates a back view of a garment with selective compressive regions.

FIG. 1B illustrates a back view of a garment 100 with selective compressive regions. As shown in FIG. 1B, the garment 100 may include a fastener 101 that allows for the user to crunch the midsection and improve the silhouette of the user. Example fasteners can include a zipper, buttons, string, or another suitable fastener. The fastener may allow for compression of the garment to the body of the user. In FIG. 1B, fastener 101 is shown as a zipper, but other suitable fasteners may be used.

As noted above, the buttocks region can include the lightest compression to create a smooth appearance but not shrink the size of the buttocks of the user. For example, the lowest level compression of 0-8 mmHg may create a smoother appearance without shrinking the size of the buttocks for some users. Other users may use a mild level of compression of 8-15 mmHg to further enhance smoothing while only slightly shrinking the size of the buttocks.

In one embodiment, a garment may comprise multiple regions. For example, a midsection region 140 can include a firm level of compression. An arm region 130, leg region 170, or thigh region 160 can include a second level of compression less than that of the midsection region. A buttocks region 150 or a chest region can include a mild or lower level of compression. The varying level of compression can provide greater comfort and selective support to various parts of a body of a user. The garment in the previous example may have more support in the arms, legs, and thighs, while having less support in the buttocks and chest. In another example, a user who wants more support in the chest may wear a garment with a higher level of compression, such as a moderate compression in the 15-20 mmHg range.

The garment may include a zipper 101 that can engage and disengage the compression between the garment and the body of the user. The compression between the garment and the body of the user may also be affected by adjusting the length and placement of the zipper. For example, the zipper 101 as shown in FIG. 1B is placed on the back of the garment and extends from below the midsection region 140 to the neck region 110, which allows for greater compression of the midsection and waist. In addition, the shape of the zipper may be used to enhance the appearance of the user. For example, FIG. 1B shows a straight zipper 101, but adding a curved portion 180 to the bottom of the zipper may create the appearance of a more shapely, enlarged and/or smoother buttocks.

The straight zipper 101 refers to the fact that when the garment 100 is not worn, the zipper 101 can be straight and has no curvature. For example, if the garment is lying flat on the ground, front side facing down, the zipper 101 can be lying flat on the ground as well.

Figure 9:
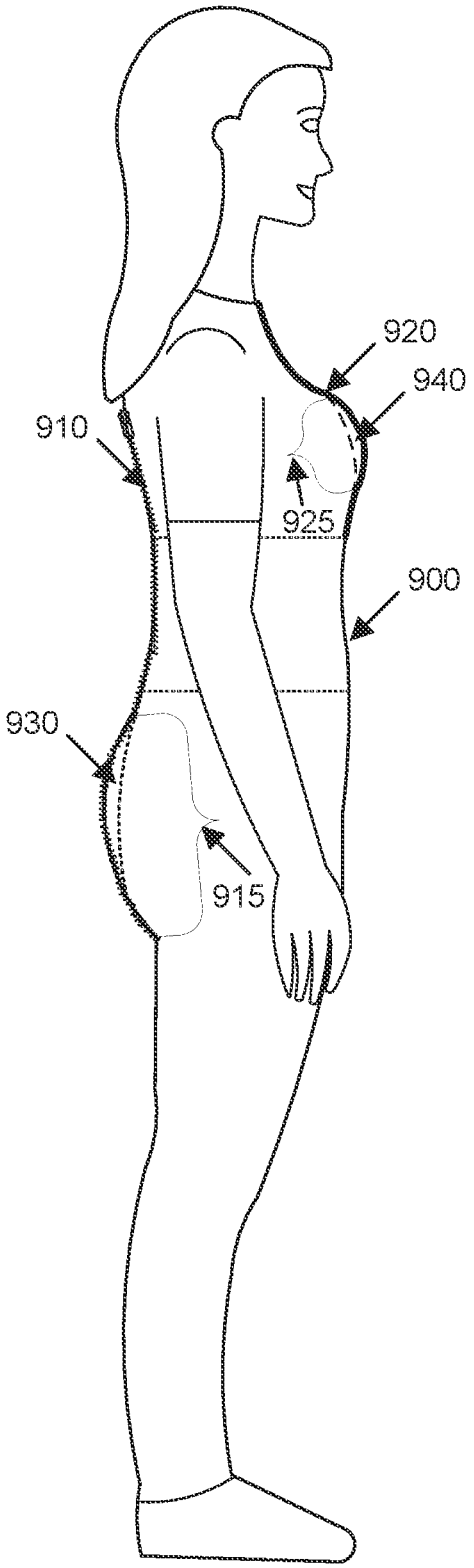
FIG. 9 shows the use of the zipper to enhance, enlarge and/or smooth the shape of a desired body part.

However, when a curved portion 180 is added to the bottom of the zipper 101, the zipper stops being straight when not worn, and if the garment is lying flat on the ground, front side facing down, the bottom portion 180 of the zipper is curved off the ground. That curved portion of the zipper creates appearance of a more shapely, enlarged and/or smoother buttocks, as shown in FIG. 9.

Figure 2:
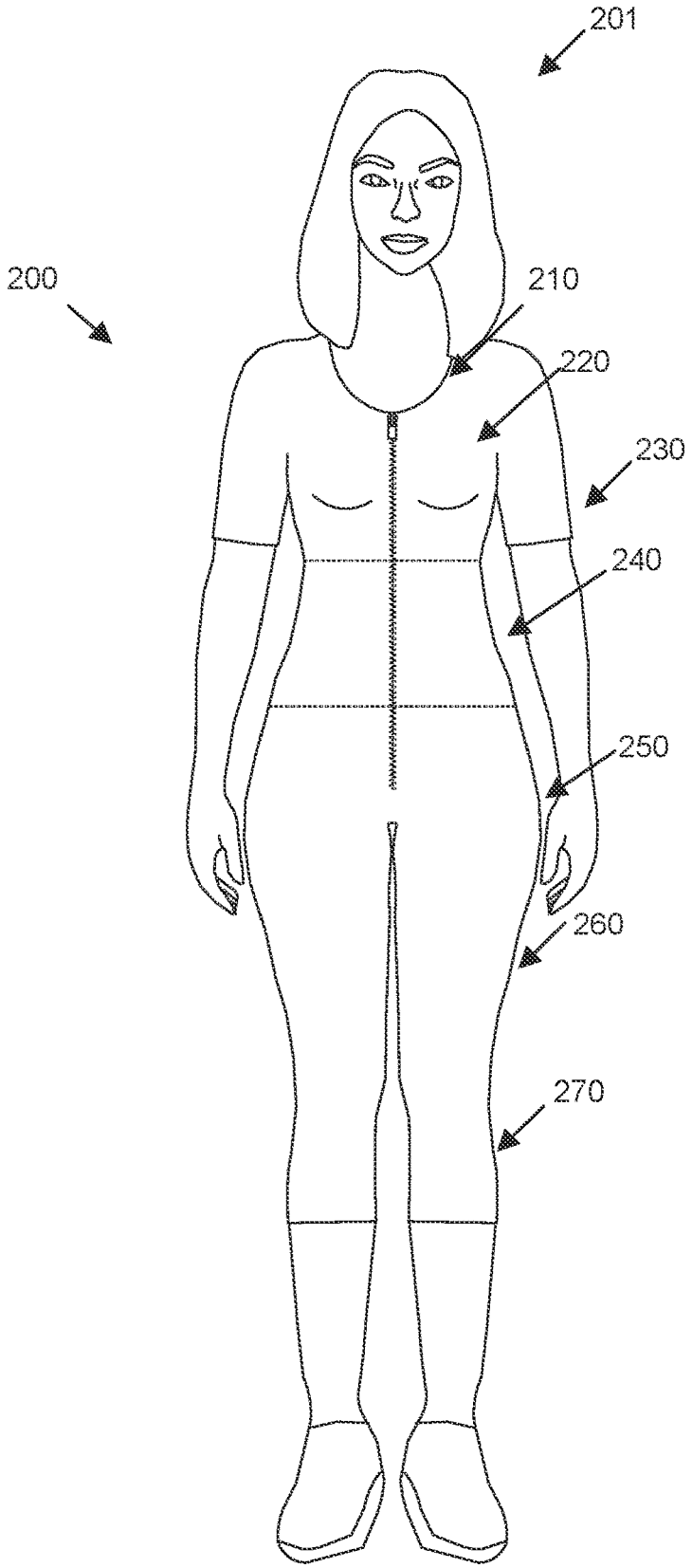
FIG. 2 illustrates a garment with selective compressive regions as worn by a user.

FIG. 2 illustrates a garment 200 with selective compression regions as worn by a user 201. In the embodiment as shown in FIG. 2, the garment can include multiple regions, such as a neck region 210, a chest region 220, an arms region 230, a midsection region 240, a buttocks region 250, a thigh region 260, and a legs region 270.

The legs region 270 may include varying lengths, such as shorts length, calf length, ankle length, or full pant length. In the embodiment as shown in FIG. 2, the legs region 270 is shown with a calf length. The legs region may include varying levels of compression. For example, the legs region may include a mild level of compression to smooth appearance and minimize cellulite. In other embodiments, the legs region may include a higher level of compression, such as moderate compression, to provide a firm appearance, provide support, or increase blood flow during exercise.

Figure 3:
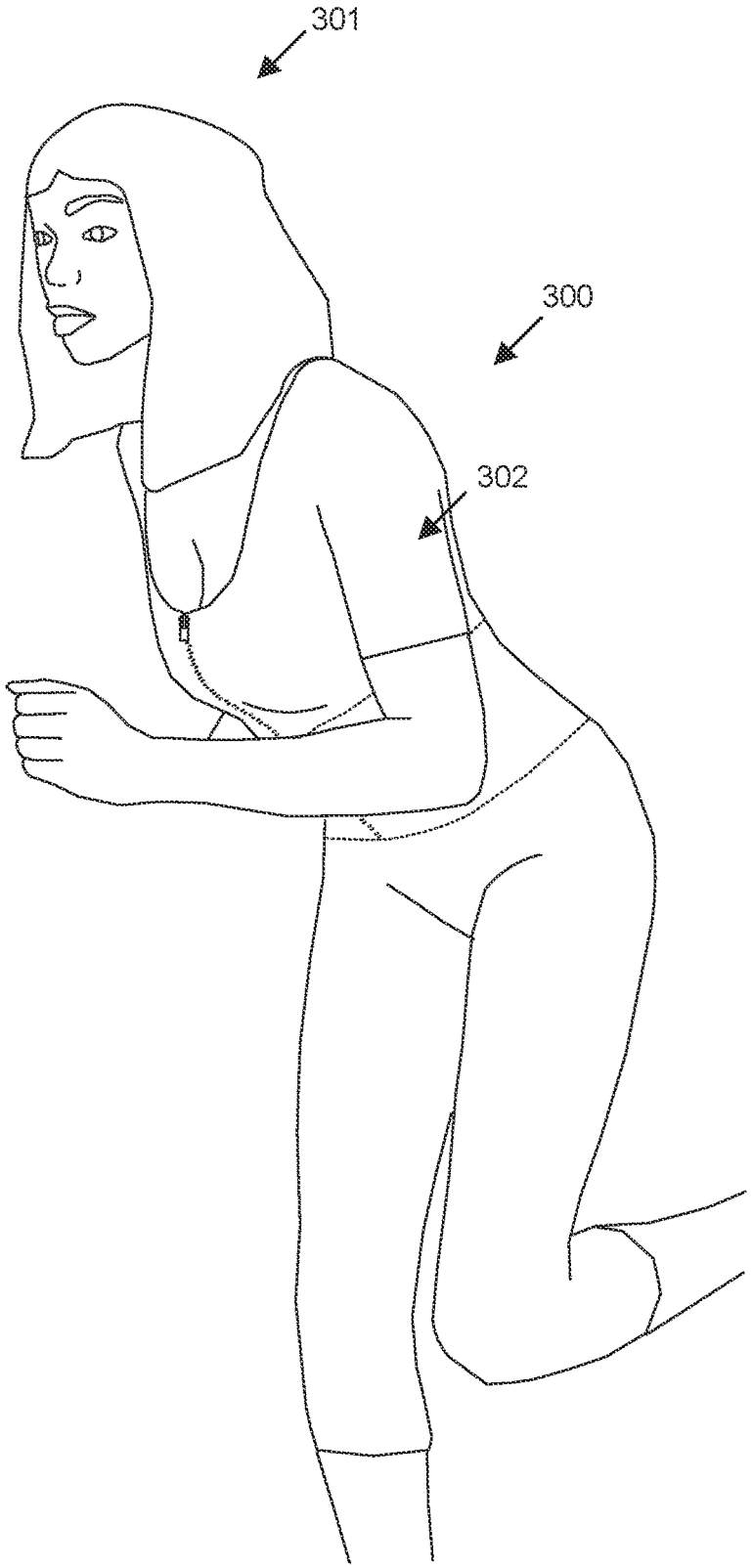
FIG. 3 illustrates a garment with selective compressive regions as worn by a user engaging in exercise.

FIG. 3 illustrates a garment 300 with selective compression regions as worn by a user 301 engaging in exercise. The garment may include an antimicrobial fabric 302 to minimize the growth of bacteria and viruses, as well as minimize odors. Example antimicrobial fabrics may be the result of treatment with copper, zinc, or silver based compounds, such as Microban® and Silpure®. The garment is not limited to aerobic exercise as shown in FIG. 3, but may also be used for weight training, yoga, or other exercises. In some embodiments, the garment may include a waterproof fabric such that the user can swim while wearing the garment. Furthermore, the garment is suitable for, but not limited to, exercise activities. The garment may be used in a variety of circumstances, including relaxing at home, running errands outside, or being worn as a base layer underneath other clothing. In some instances, the user benefits from a garment with selective compression by enhancing the user's desired aesthetics as described herein. The user may then wear the garment by itself, or the user may use the enhanced aesthetics in conjunction with other clothing. For example, the user may use a garment with selective compression to cinch the user's waist, which then enables the user to more easily fit into a pair of pants. In another example, the user may wear the garment without layering other clothing, as shown in FIG. 3.

In addition, selective compression may increase the comfort of the garment, enabling the user to wear the garment all day, unlike garments without selective compression that may feel too tight in some areas of the user's body while being too loose in other areas. An antimicrobial fabric may further enable the user to wear the garment for longer periods of time. For exercise, compression may benefit the user by providing support, reducing fatigue, increasing blood flow, and decreasing recovery time.

Figure 4:
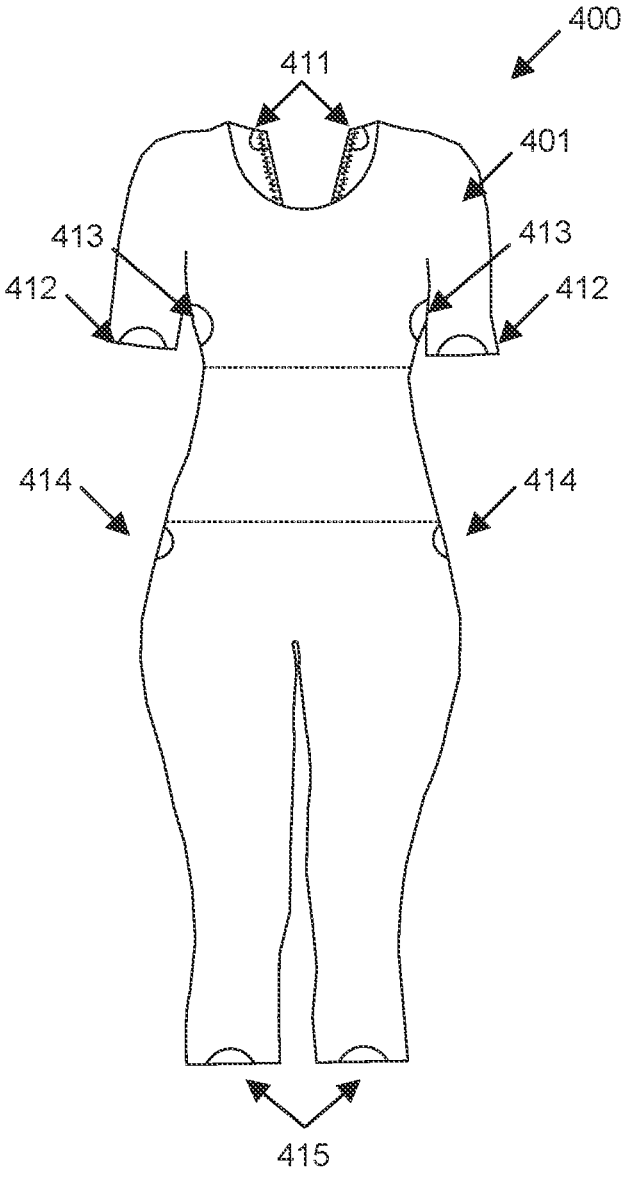
FIG. 4 illustrates an interior view of a garment with selective compressive regions.

FIG. 4 illustrates an interior view of a garment 400 with selective compressive regions. In some embodiments, the garment may include an interior lining 401. The interior lining can include slots located in different regions of the garment, such as slots 411 in the back of the garment, slots 412 in an arm region, slots 413 in a chest region, slots 414 in an upper leg region, and slots 415 in a lower leg region of the garment. The slots can be used to hold various items, such as hot or cold packs, bra cups, or additional compression mechanisms such as padding, binding or lipo foam. For example, a user suffering from shoulder pain may choose to insert a cold pack into slots 411 in the back of the garment 400. In another example, the user may insert bra cups into slots 413 in the chest region to provide additional support for the bust. These slots may be located anywhere on the garment and are not limited to those locations as shown in FIG. 4. For example, slots may be located in a knee region, suitable for knee pads, or in a midsection region. Similarly, slots may be located on the exterior of the garment, for example to create an exterior pocket suitable for cash or a cell phone. As illustrated in FIG. 4, slots 414 in an upper leg region are included in the interior lining 401 to create an interior pocket. Slots instead placed in the exterior could be used to mimic a traditional pants pocket placement, for example to hold cards, money, or a cell phone.

The slots 414, 413, 412 can hold padding and can be positioned over the buttocks to enlarge the appearance of the buttocks, or over the chest to enlarge the appearance of the chest. The slots 414, 413, 412 are placed on the inside of the garment 400, in the interior lining 401, so that their existence and seams are not visible on the outside of the garment 400.

In addition, the slots 414, 413, 412 can act as an adjustable compression or enlargement mechanism by allowing the wearer to insert compressing objects such as tape or lipo foam, or enlarging objects such as padding.

Figure 5:
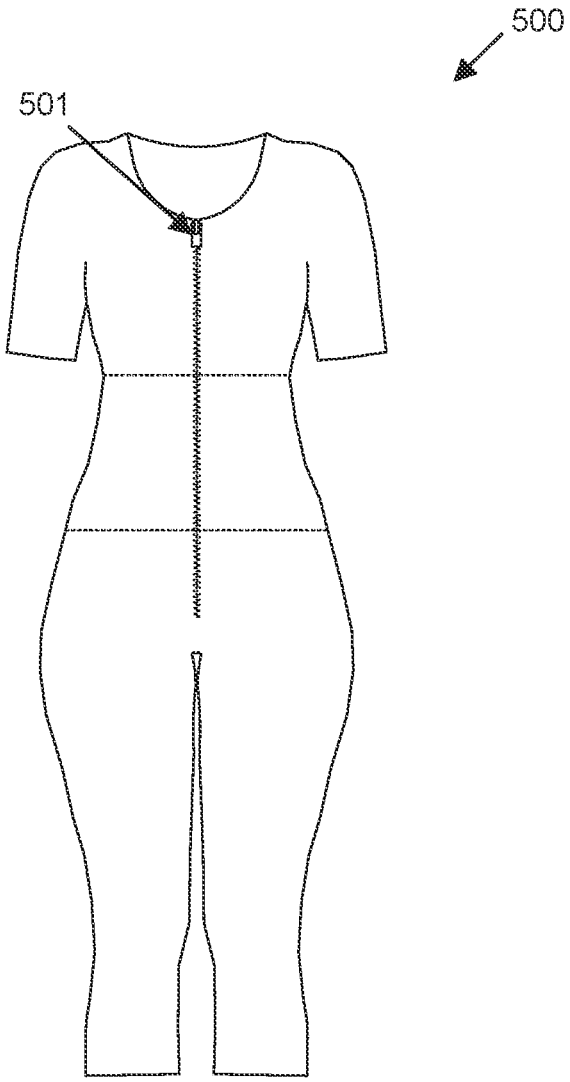
FIG. 5 illustrates a garment with selective compressive regions including a front fastener.

FIG. 5 shows an example garment 500 including a zipper 501. The zipper 501 can extend along a central portion of the garment from a lower midsection area to an upper midsection area. The zipper 501 in FIG. 5 extends beyond the midsection to a neck area of the garment. In some embodiments, a zipper placed on the front of the garment in this manner can accentuate the hips, add curvature to the waist, and lift the bust of the user. In addition, the shape of the zipper can affect the appearance of the user. For example, a curved portion can be included in the zipper 501 near the chest to create the appearance of a fuller chest.

Figure 6:
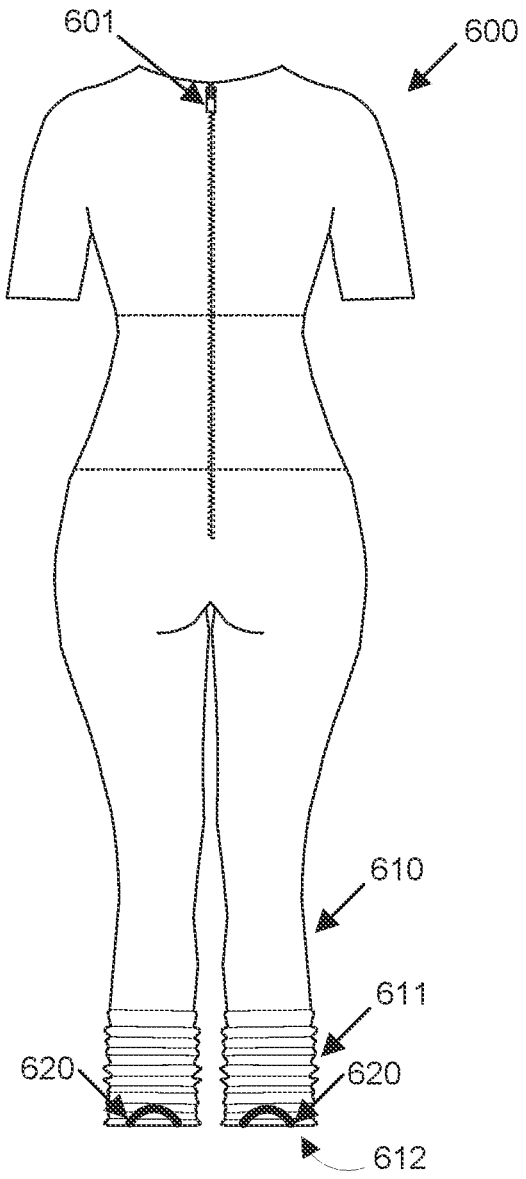
FIG. 6 illustrates a garment with selective compressive regions including a back fastener.

FIG. 6 illustrates an example garment 600 including a zipper 601 on the back of the garment. The zipper can extend along a central portion of the garment from a lower midsection area to an upper midsection area. The zipper 601, as shown in FIG. 6, extends beyond the midsection to a neck area of the garment. In certain embodiments, the zipper can be placed on the back of the garment to enhance the appearance of the waist and buttocks. As noted above, the shape of the zipper can affect the appearance of the user. For example, a curved portion can be included near the bottom of the zipper to give the appearance of a more shapely, enlarged and smoother buttocks.

The garment may include a legs region 610 of varying lengths. As shown in the embodiment in FIG. 6, the legs region 610 may include a full pant length. The legs region may further include a ruched portion 611. In some embodiments, the ruched portion may enable the user to adjust the length of the legs region to their liking. In addition, the ruched portion may further include a sock portion 612 so the user can pull the sock portion over the user's feet, removing the need to wear a separate pair of socks.

The ruched region 611 can include a pocket 620 at the end of the leg region 170 in FIG. 1A that can be used to insert padding or cushion. When the ruched region 611 turns into a sock, the pocket 620 can fit over the toes and/or ball of the foot. Padding or cushion can be inserted in this pocket 620 for comfort, protection, or to elongate the foot.

Figure 7A:
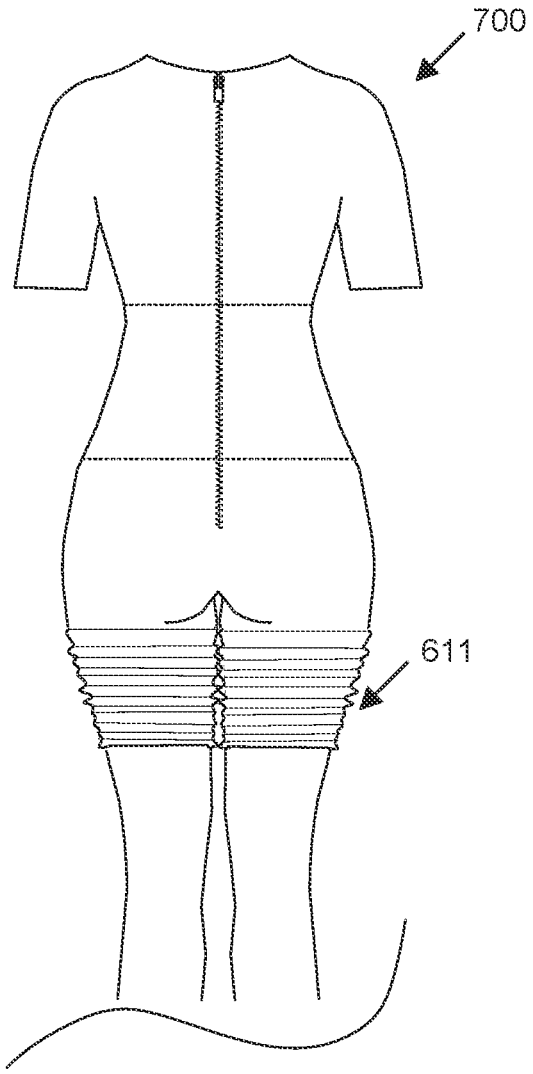
FIG. 7A illustrates an example garment with the ruched portion used to enlarge and/or shape the buttocks.

FIG. 7A illustrates an example garment with the ruched portion used to enlarge, support and/or shape the buttocks. The ruched portion 611 can be mobile and can be moved further up the leg of the garment 700 using a friction enhancing mechanism such as hook and loop mechanism as explained below. The ruched portion 611 compresses the flesh that it covers, e.g. the thighs, and provides an upward lift, and support, to the buttocks thus enhancing the shape of the buttocks by making them appear more firm, round and muscular.

Figure 7B:
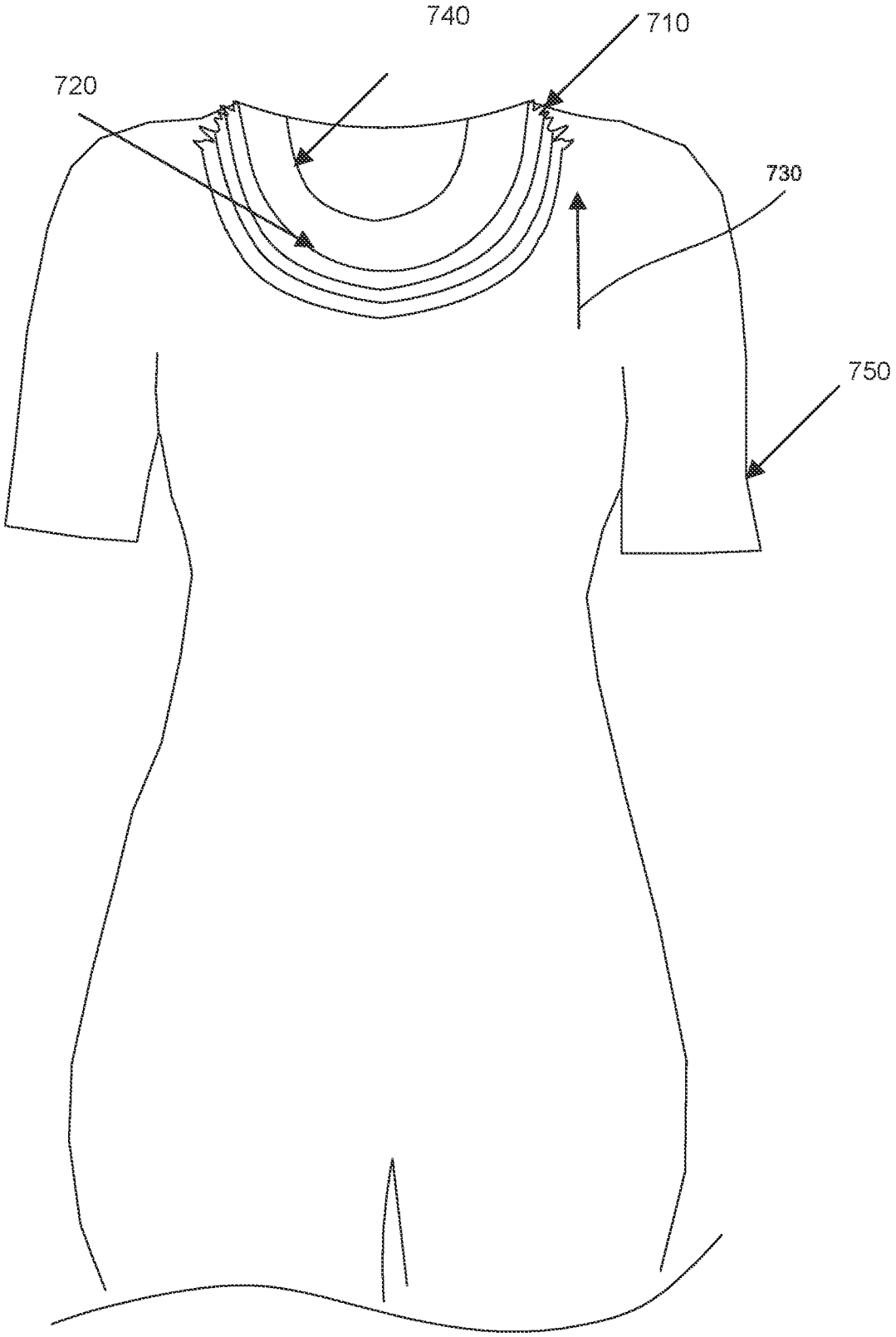
FIG. 7B illustrates an example garment with the ruched portion used to lower or heighten the neckline.

FIG. 7B illustrates an example garment with the ruched portion used to lower or heighten the neckline. The ruched portion 710 can also surround the neckline 720. The ruched portion 710 when scrunched or ruched, can create a low neckline and can create folds around the neckline 720.

The ruched portion 710 can be mobile and can be extended upwards 730, to varying degrees up until the ruched portion 710 is completely flat, i.e. not scrunched anymore, thus creating a higher neckline 740. Extending the ruched portion 710 up and down the neckline between the lowest neckline 720, and the highest neckline 740, can trade the neckline folds with the height of the neckline. The positioning of the ruched portion 710 can be very accurate and can be achieved using a friction enhancing mechanism such as a hook and loop mechanism built into the garment 750, as described in this application.

Figure 8:
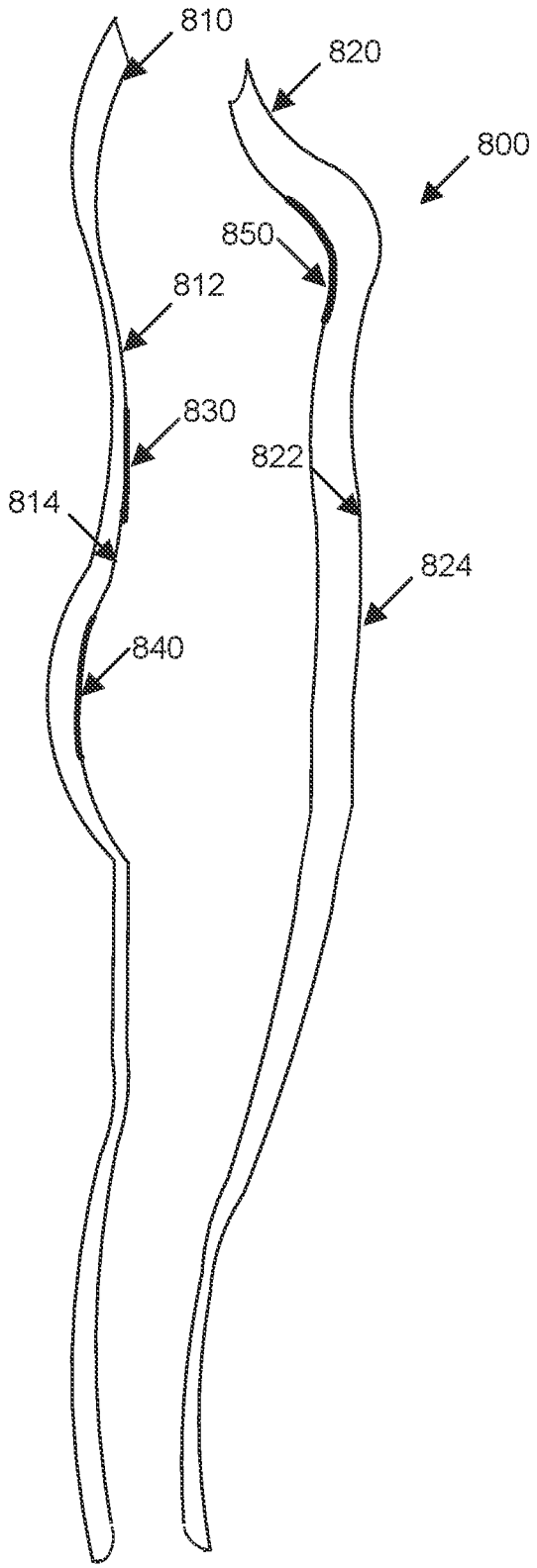
FIG. 8 shows the mechanism by which the ruching can operate.

FIG. 8 shows the mechanism by which the ruching can operate. The garment 800 can include an inner, or interior, lining 810 and an outer lining 820, both of which are connected. The inner lining 810 can fully cover interior of the garment 800, and can include slots as described in this application. The inner lining can have two surfaces 812 and 814. Similarly, the outer lining 820 can have two surfaces 822 and 824.

Surface 812 can be the surface of the inner lining 810 facing the wearer, while the surface 814 can be the surface of the inner lining 810 facing the surface 822 of the outer lining 820. Surface 824 of the outer lining 820 can be facing the outside, in other words away from the wearer.

The surfaces 814 and 822 can have enhanced friction to allow creation of the ruched portion 611 in FIG. 6. To create the enhanced friction, the surface 814 and 822 can be a hook and loop surfaces, akin to Velcro. Alternatively, the surfaces 814 and 822 can have enhanced friction through electrostatic attraction created by rubbing the two materials together.

For example, 814 can be a loop surface while 822 can be a hook surface, or vice versa. The wearer can move, e.g. slide, a portion of the outer lining 820 with respect to the inner lining 810, to create a ruched portion. Specifically, the hook and loop surfaces 814 and 812 can create enhanced friction, maintaining the position of the ruched portion.

Surface 812 can be soft and comfortable, and can be covered with antimicrobial materials to prevent unpleasant odor. In addition, the surface 812 can include material containing loop like structures, for example fuzzy material, which can enable the user to attach padding at arbitrary places on the surface 812 using a hook like material attached to the padding. In effect surface 812 can allow the wearer to sculpt the body by adding padding anywhere on the surface 812.

In one embodiment, the slots 414, 413, 412 in FIG. 4 can be formed solely within the inner lining 810, without touching the outer lining 820. In another embodiment, the slots 414, 413, 412 can be slits 830, 840, 850 formed within the inner lining 810, enabling the wearer to selectively and adjustably sculpt the wearer's body by using the sculpting object such as an enlargement object or a compression object.

For example, to enlarge the body, the wearer can place an enlarging object, such as padding, that has an attachment mechanism through the slits 830, 840, 850 at a desired location, such as the buttocks, the chest, or the waist. In another example, to compress the body, the wearer can place a compressing object, such as tape, corset, or lipo foam, that has an attachment mechanism through the slits 830, 840, 850 at the desired location, such as the waist. The sculpting object can have one or both side that can attach to the surface 814 and/or surface 822.

The attachment mechanism can be configured to secure the sculpting object to the garment by using for example a hook and loop attachment mechanism. The attachment mechanism can be formed on a surface 814 of the inner lining 810 facing user or formed on a surface 822 of the outer lining 820 facing the inner lining.

Little or no compression in the buttocks region 150 in FIG. 1A enables comfortable long sits and eases pulling the garment 800 up and down. The wearer can also insert a compatible object in the buttocks region 150 for added comfort or to enlarge to enlarge the buttocks region. The compatible object can include lipo foam, ice packs, cold packs, heating pads, floatation devices, etc. The compatible object can be inserted into slots 414, 413, 412 to attach to the garment 800. Alternatively, the compatible object can be attached to the garment 800 using enhanced friction, as described in this application.

The garment 800 can be therapeutic and calm anxiety by enabling the wearer to shift compression levels around the body via placing compressing and enlarging objects and moving ruching throughout the garment. Selective compression in the garment 800 provides targeted deep pressure touch that aids the regulation of the nervous system, and the wearer have the option to adjust the locations of deep pressure.

In one embodiment, to create the deep pressure, the garment 800 can couple to a compressing object using the enhanced friction mechanism as described in this application. The compressing object can have a narrow focus point, and can be shaped as a conical frustum, or a cylinder.

In another embodiment, the mobile ruching region 611 in FIG. 7A, 710 in FIG. 7B can therapeutically exert pressure at a desired location, similarly to the medical and therapeutic procedure which uses elastic bands for constriction. The wearer can create ruching region 611, 710 at any point on the garment 800 by scrounging the outer lining 820 at the desired location, thus effectively shortening the garment at the arms, legs, and/or the neckline.

The mobile ruching region 611, 710 can also be used to shorten the garment 800 for wearers with varying heights, proportions, and accessibility needs.

Movement of the ruching region 611, 710 up and down the garment 800 can adjust the wearer's silhouette and can allow the wearer to create different looks. The adjustments emphasize and cinch parts of the body when the linings of the fabric catch in targeted places. The mobile ruching region 611, 710 is similar to the functionality of a garter or belt that cinches and shifts the appearance of body fat/weight. The wearer can use the ruching region 611, 710 to cup the chest and add definition to bust or add height/length to the neckline. Likewise, the ruching region 611, 710 can be moved to lengthen the leg region 170 in FIG. 1A and create a sock to protect, warm, and cover the wearer's foot. The lining's fabrics can secure placement of the mobile excess fabric with a loop and hoop functionality.

FIG. 9 shows the use of the zipper to enhance, enlarge and/or smooth the shape of a desired body part. The zipper 910, 920 can shape the garment 900 by being rigid and providing structure, through curving and stiffness, thus allowing the garment to separate from the body of the wearer. In effect, the zipper 910, 920 can create an air pocket 930, 940, thus changing, more specifically enlarging, the shape of a desired body part, such as buttocks and breasts. The zipper 910, 920 can extend partway over the shaped body part, or can extend all the way over the desired body part.

The zipper 910, 920 can include an outwardly curved portion 915, 925, that does not conform to the shape of the body, and creates its own shape, enlarging, shaping, and smoothing, the desired body part. For example, the zipper 910, 920 by creating its own shape, can smooth the appearance of the desired body part, thus reducing or completely eliminating the appearance of cellulite.

Overall, the desired body part, can be shaped using multiple mechanisms including slots configured to receive padding in the desired body parts, zipper configured to separate from the body by being curved and stiff, thus creating an air pocket and enlarging the desired body part, and/or a selective compression mechanism. The selective compression mechanism can compress the body surrounding the desired body part, while leaving the desired body part uncompressed, thus creating an appearance of volume in the desired body part by contrast with the compressed body part. In addition to the appearance of volume through compression contrast, the desired body part can be enlarged using the various mechanisms described in this application such as the zipper, the padding, and/or the ruching.

From the foregoing, it will be appreciated that specific embodiments of the invention have been described herein for purposes of illustration, but that various modifications may be made without deviating from the scope of the invention. Accordingly, the invention is not limited except as by the appended claims.

What is claimed is:

1. A garment comprising:

a first portion configured to cover a chest of a wearer, the first portion having a first compression level;

a second portion configured to cover a waist of the wearer, the second portion having a second compression level, wherein the second compression level is greater than that of the first compression level;

multiple mechanisms configured to enlarge an appearance of a buttocks region of the wearer including:

a third portion configured to cover the buttocks region of the wearer, the third portion having a third compression level, wherein the third compression level is less than the second compression level;

a zipper placed on a back of the garment and extending from the third portion to the first portion of the garment, wherein the zipper includes an outwardly curved portion in a region of the zipper associated with the third portion of the garment, wherein the outwardly curved portion of the zipper is configured to enlarge the appearance of the buttocks region of the wearer; and a slot formed within a portion of an interior lining fully covering an interior of the garment, the slot configured to receive a padding, thereby enabling the wearer to selectively enlarge the buttocks region of the wearer.

2. The garment of claim 1, comprising:

an inner lining configured to face the wearer;

an outer lining configured to face away from the wearer;

a slit formed within the inner lining configured to enable the wearer to selectively sculpt a wearer's body by enabling the wearer to insert a sculpting object between the inner lining and the outer lining, wherein the sculpting object includes a compression object or an enlargement object;

an attachment mechanism formed on a surface of the inner lining facing the outer lining or formed on a surface of the outer lining facing the inner lining, wherein the attachment mechanism is configured to secure the sculpting object to the garment.

3. The garment of claim 1, comprising:

an inner lining configured to face the wearer;

an outer lining configured to face away from the wearer;

a ruched portion surrounding a neckline associated with the garment, the ruched portion configured to heighten or lower the neckline associated with the garment;

an attachment mechanism coupled to the ruched portion configured to enable the wearer to position the ruched portion at a desired height, wherein the attachment mechanism is configured to create enhanced friction between the inner lining and the outer lining.

4. The garment of claim 1, comprising:

an inner lining configured to face the wearer;

an outer lining configured to face away from the wearer;

a ruched portion configured to surround an ankle of the wearer, the ruched portion configured to extend to a foot of the wearer when stretched; and an attachment mechanism coupled to the ruched portion configured to enable the wearer to position the ruched portion at a desired length along the foot, wherein the attachment mechanism is configured to create enhanced friction between the inner lining and the outer lining.

5. The garment of claim 1, comprising:

the first portion configured to create an appearance of a fuller chest, the first portion including a second outwardly curved zipper creating an air pocket between the chest of the wearer and the second outwardly curved zipper, wherein the air pocket is configured to create the appearance of the fuller chest.

6. The garment of claim 1, wherein the second compression level is between 20-30 mmHg.

7. The garment of claim 1, wherein the second portion is stitched into the first portion and the third portion to comprise a unitary garment, wherein the second compression level of the second portion is configured to compress a midsection of the wearer.

8. A garment comprising:

a first portion configured to extend over a midsection area of a wearer, the first portion having a first compression level compressing the midsection area of the wearer; and multiple mechanisms configured to shape an appearance of a desired body region of the wearer including:

a second portion configured to extend over the desired body region of the wearer, the second portion having a second compression level, wherein the first compression level is greater than the second compression level;

a zipper placed on a back of the garment and extending from the first portion to the second portion of the garment, wherein the zipper includes a curved portion in a region of the zipper associated with the second portion of the garment, wherein the curved portion of the zipper is configured to enlarge the appearance of the desired body region of the wearer; and a slot formed solely within a portion of an interior lining fully covering an interior of the garment, the slot configured to receive a padding, thereby enabling the wearer to selectively enlarge the desired body region.

9. The garment of claim 8, comprising:

an inner lining configured to face the wearer;

an outer lining configured to face away from the wearer;

a slit formed within the inner lining configured to enable the wearer to selectively sculpt a wearer's body by enabling the wearer to insert a sculpting object between the inner lining and the outer lining, wherein the sculpting object includes a compression object or an enlargement object;

an attachment mechanism formed on a surface of the inner lining facing the outer lining or formed on a surface of the outer lining facing the inner lining, wherein the attachment mechanism is configured to secure the sculpting object to the garment.

10. The garment of claim 8, comprising:

an inner lining configured to face the wearer;

an outer lining configured to face away from the wearer;

a ruched portion surrounding a neckline associated with the garment, the ruched portion configured to heighten or lower the neckline associated with the garment;

an attachment mechanism coupled to the ruched portion configured to enable the wearer to position the ruched portion at a desired height, wherein the attachment mechanism is configured to create createsenhanced friction between the inner lining and the outer lining.

11. The garment of claim 8, comprising:

an inner lining configured to face the wearer;

an outer lining configured to face away from the wearer;

a ruched portion configured to surround an ankle of the wearer, the ruched portion configured to extend to a foot of the wearer when stretched;

an attachment mechanism coupled to the ruched portion configured to enable the wearer to position the ruched portion at a desired length along the foot, wherein the attachment mechanism is configured to create enhanced friction between the inner lining and the outer lining.

12. The garment of claim 8, comprising:

the second portion configured to create an appearance of a fuller chest, the second portion including a second outwardly curved zipper creating an air pocket between a chest of the wearer and the second outwardly curved zipper, wherein the air pocket is configured to create the appearance of the fuller chest.

13. The garment of claim 8, wherein the first portion is stitched to the second portion to comprise a unitary garment.

14. The garment of claim 8, further comprising:

a third portion configured to extend over a chest of the wearer, the third portion having a third compression level, wherein the third compression level is less than the first compression level, thereby configured to create an appearance of a fuller chest; and a bra-support built into the third portion.

15. The garment of claim 8, comprising:

a third portion including sleeves configured to extend along an arm portion of the wearer, wherein the third portion has a third compression level, wherein the third compression level is greater than the first compression level.

16. A method for manufacturing a garment that includes varying levels of compression, comprising:

affixing a first portion extending from a neck region of the garment to an upper portion of a midsection area of the garment to a second portion extending from the upper portion of the midsection area to a lower portion of the midsection area, the first portion having a first compression level and the second portion having a second compression level that is greater than that of the first compression level;

affixing the second portion to a third portion extending from the lower portion of the midsection area to a leg area of the garment, the third portion having the first compression level; and providing multiple mechanisms configured to enlarge an appearance of a desired body region of a wearer including:

providing the third portion is configured to cover the desired body region of the wearer, wherein the first compression level is less than the second compression level;

providing a zipper placed on a back of the garment and extending from the third portion to the neck region of the garment, wherein the zipper includes a curved portion in a region of the zipper associated with the third portion of the garment, wherein the curved portion of the zipper is configured to enlarge the appearance of the desired body region of the wearer; and providing a slot formed solely within a portion of an interior lining of the garment and configured to receive a padding, thereby enabling the wearer to selectively enlarge the desired body region.

17. The method of claim 16, comprising:

providing an inner lining associated with the garment configured to face the wearer;

providing an outer lining associated with the garment configured to face away from the wearer;

providing a slit formed within the inner lining configured to enable the wearer to selectively sculpt a wearer's body by enabling the wearer to insert a sculpting object between the inner lining and the outer lining, wherein the sculpting object includes a compression object or an enlargement object;

providing an attachment mechanism formed on a surface of the inner lining facing the outer lining or formed on a surface of the outer lining facing the inner lining, wherein the attachment mechanism is configured to secure the sculpting object to the garment.

18. The method of claim 16, comprising:

providing an inner lining associated with the garment configured to face the wearer;

providing an outer lining configured associated with the garment to face away from the wearer;

providing a ruched portion surrounding a neckline associated with the garment, the ruched portion configured to heighten or lower the neckline associated with the garment;

providing an attachment mechanism coupled to the ruched portion configured to enable the wearer to position the ruched portion at a desired height, wherein the attachment mechanism is configured to create enhanced friction between the inner lining and the outer lining.

19. The method of claim 16, comprising:

providing an inner lining associated with the garment configured to face the wearer;

providing an outer lining associated with the garment configured to face away from the wearer;

providing a ruched portion configured to surround an ankle of the wearer, the ruched portion configured to extend to a foot of the wearer when stretched;

providing an attachment mechanism coupled to the ruched portion configured to enable the wearer to position the ruched portion at a desired length along the foot, wherein the attachment mechanism is configured to create enhanced friction between the inner lining and the outer lining.

20. The method of claim 16, comprising:

configuring the first portion to create an appearance of a fuller chest, the first portion including a second outwardly curved zipper creating an air pocket configured to be between a chest of the wearer and the second outwardly curved zipper, wherein the air pocket is configured to create the appearance of the fuller chest.

* * * * *